United States Patent [19]

Stout

[11] Patent Number: 4,523,649

[45] Date of Patent: Jun. 18, 1985

[54] ROTATIONAL ALIGNMENT METHOD AND APPARATUS FOR TUBING CONVEYED PERFORATING GUNS

[75] Inventor: Gregg W. Stout, Montgomery, Tex.

[73] Assignee: Baker Oil Tools, Inc., Orange, Calif.

[21] Appl. No.: 497,834

[22] Filed: May 25, 1983

[51] Int. Cl.[3] ..... E21B 43/118

[52] U.S. Cl. ..... 175/4.51; 175/4.6

[58] Field of Search ..... 175/4.51, 4.5, 4.6; 166/297, 55, 55.1, 254, 255; 285/278, 280, 281, 355, 390, 370, 383, 397

[56] References Cited

U.S. PATENT DOCUMENTS

| | | | |
|---|---|---|---|
| 2,414,997 | 1/1947 | Atkins | 285/278 |
| 2,833,214 | 5/1958 | Spencer | 175/4.6 |
| 3,565,188 | 6/1965 | Hakala | 175/4.6 |
| 4,140,188 | 2/1979 | Vann | 175/4.6 X |
| 4,269,278 | 5/1981 | Vann | 175/4.51 |

*Primary Examiner*—James A. Leppink
*Assistant Examiner*—Thuy M. Bui
*Attorney, Agent, or Firm*—Norvell & Associates

[57] ABSTRACT

A method and apparatus are provided for angularly aligning normally vertical rows of explosive charge containers mounted on a tubing conveyed perforating gun carrier so that none of the explosive charges is directed substantially vertically upwardly in the event that perforation is accomplished in a non-vertical section of the well casing.

2 Claims, 6 Drawing Figures

ROTATIONAL ALIGNMENT METHOD AND APPARATUS FOR TUBING CONVEYED PERFORATING GUNS

BACKGROUND OF THE INVENTION

1. Field of the Invention

The invention relates to a method and apparatus for effecting the angular alignment of a plurality of angularly spaced shaped charges of a tubing conveyed well casing perforating gun to insure that none of the explosive charges are directed vertically upwardly in any non-vertical section of the well casing.

2. Description of the Prior Art

It is well known that any drilled well never proceeds on an exactly vertical path to a production formation. In fact, it is not unusual to have the well bore, and hence the well casing, enter a production formation at a substantial angle to the vertical, approaching a horizontal angle on the order of 15°. If a conventional perforating gun were employed to effect the perforation of the well casing in any such non-vertical section, it is most likely that a plurality of the explosive charges carried by the gun would be directed almost vertically upwardly. Such vertically upwardly directed perforations in a well casing are highly undesirable, since they permit the ready flow of sand and other particulate material directly into the casing and present obvious problems insofar as the completion and production operation of the well are concerned. On the other hand, it is desirable that a plurality of axially and angularly spaced perforations be produced in the non-vertical section of the casing in order to facilitate the entry of well fluids into the casing in all but a vertically downward direction.

It is equally desirable from an economic standpoint that the perforating and gravel packing of the well casing be accomplished with a single trip of a combined perforating and gravel packing apparatus in the well. Such single trip apparatus is dislosed and claimed in the co-pending application Ser. No. 366,267 (BSC-76) filed Apr. 7, 1982, and assigned to the assignee of the instant invention. An essential element of such one trip perforating and gravel packing apparatus is the provision of an uninterrupted conduit extending from the gravel packing apparatus to the well head. Such conduit not only permits a detonating weight to be dropped on the perforating gun but also provides a path for the flow of well flushing and gravel packing fluids.

An apparatus for effecting the perforating of a well casing by a perforating gun suspended from a continuous conduit extending to the well head and permitting angular alignment of the explosive charges of the perforating gun so that no charges are disposed in a vertically upward direction in a non-vertical section of the casing, has not heretofore been provided in the prior art in tubing conveyed perforating guns.

SUMMARY OF THE INVENTION

The invention provides a method and apparatus for effecting the angular alignment of a plurality of angularly and vertically spaced explosive charges carried by a perforating gun on the bottom end of a tubular conduit so as to automatically position the explosive charges so that no charges are directed vertically upwardly in the event that perforation of the casing is desired in a non-vertical section thereof.

The invention contemplates the angular disposition of the explosive charges of a perforating gun assembly on a tubular carrier in such manner that the explosive charges define a plurality of angularly spaced, vertical rows when the axis of the carrier is vertical. Moreover, the perforating gun assembly is secured to the tubular conduit by an annular thrust bearing so that the assembly may rotate relative to the casing under the influence of any non-concentric gravitational force on the assembly. In accordance with this invention, the entire perforating gun assembly is mounted within a cylindrical housing which is provided with one or more axially extending, axially aligned, narrow ribs on its periphery. The ribs shift the center of gravity so as to insure that the perforating gun assembly will gravitationally rotate in any non-vertical section of the casing to a position where the rib lies on either side of a vertical plane passing through the axis of the perforating gun assembly. Moreover, the narrow rib is angularly located relative to the aforementioned vertical rows of explosive charge containers so that no row is less than 120° displaced from the rib. In this manner, it is assured that no row of containers will be disposed in or about a vertically upwardly directed position in a non-vertical section of the well casing.

FIGS. *2a* and *2b* collectively constitute a quarter sectional view of a perforating gun embodying this invention.

Figure 1:
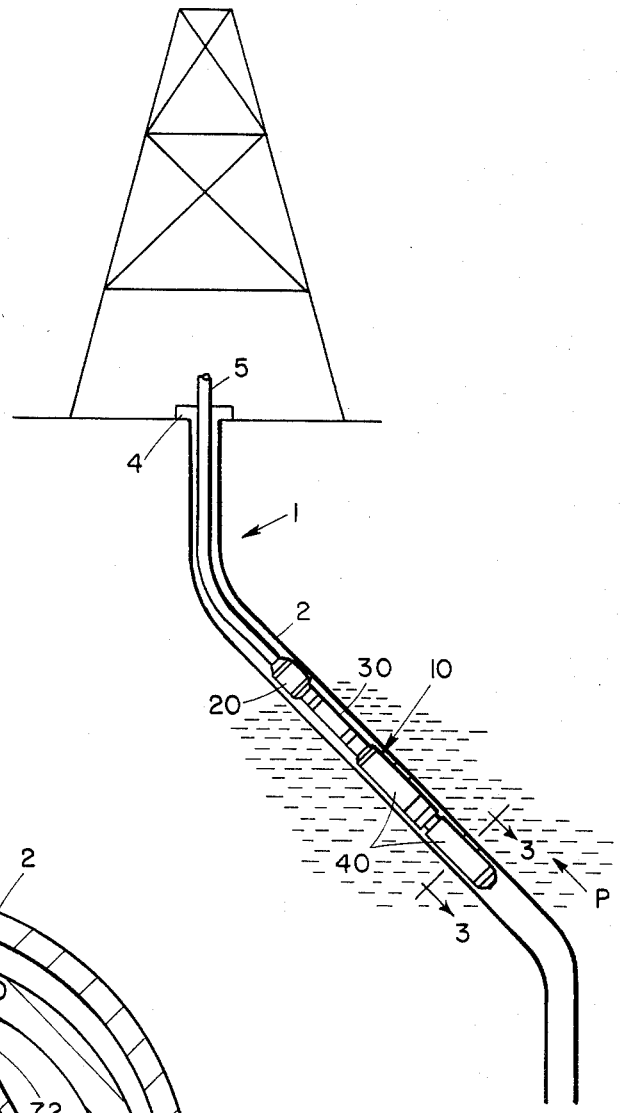
FIG. 1 is a perspective, vertical sectional view of a subterranean well and casing wherein the casing passes through a production formation along an axis that is at an angle to the vertical.
Figure 3:
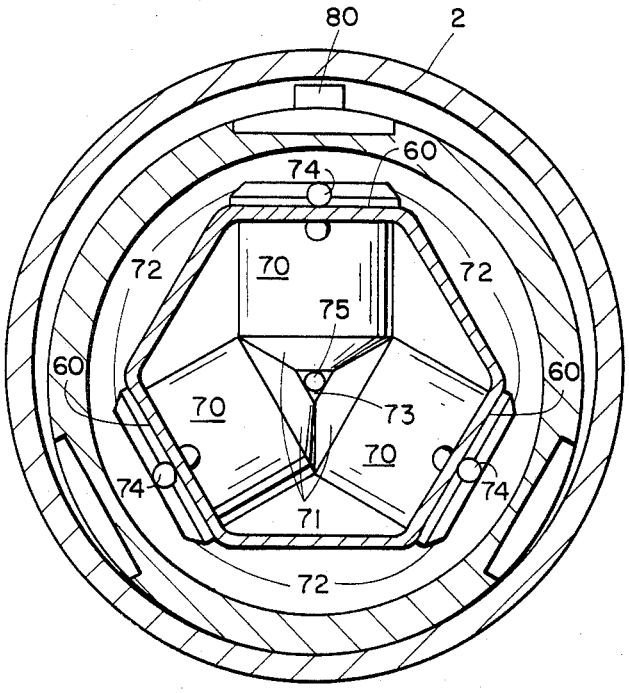
Figure 2A:
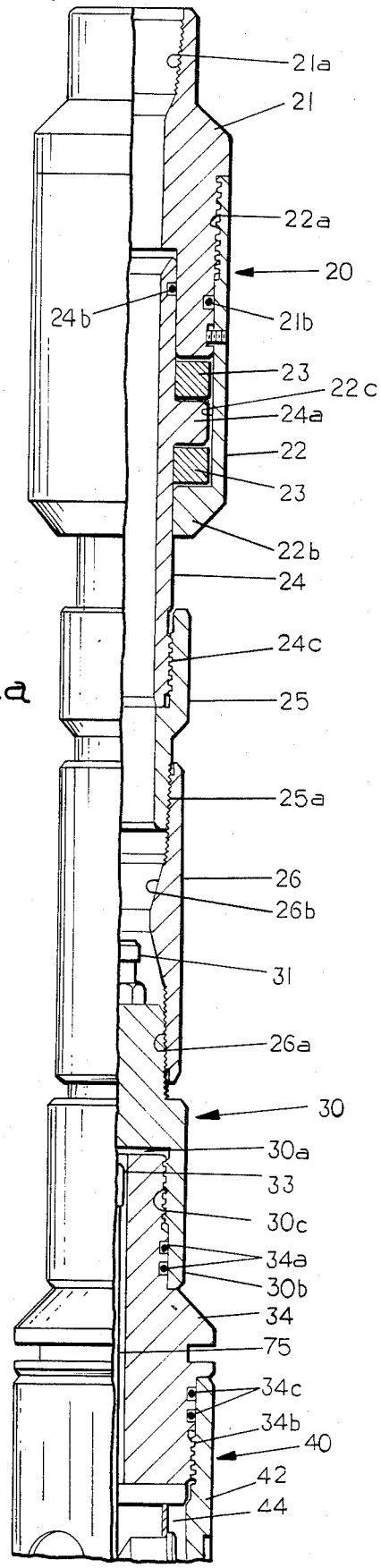
Figure 2B:
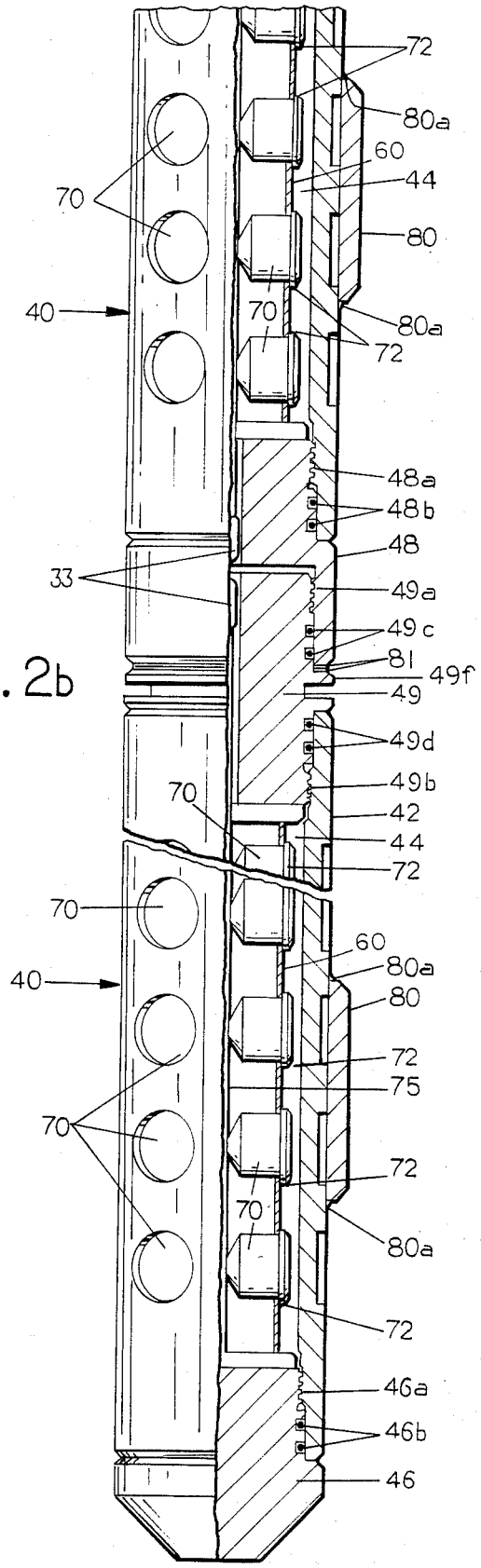

FIG. 3 comprises a greatly enlarged cross sectional view taken on the plane 3—3 of FIG. 1.

Figure 4:
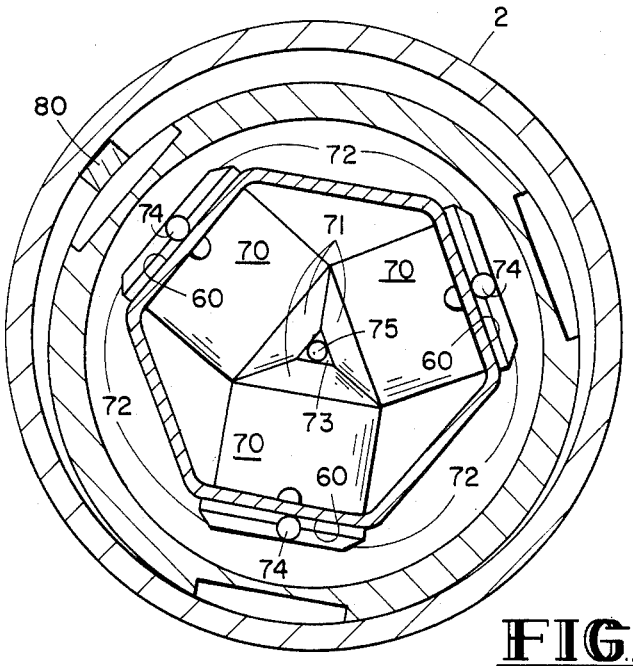

FIG. 4 is a view similar to FIG. 3 but illustrating one extreme angular position of the perforating gun.

Figure 5:
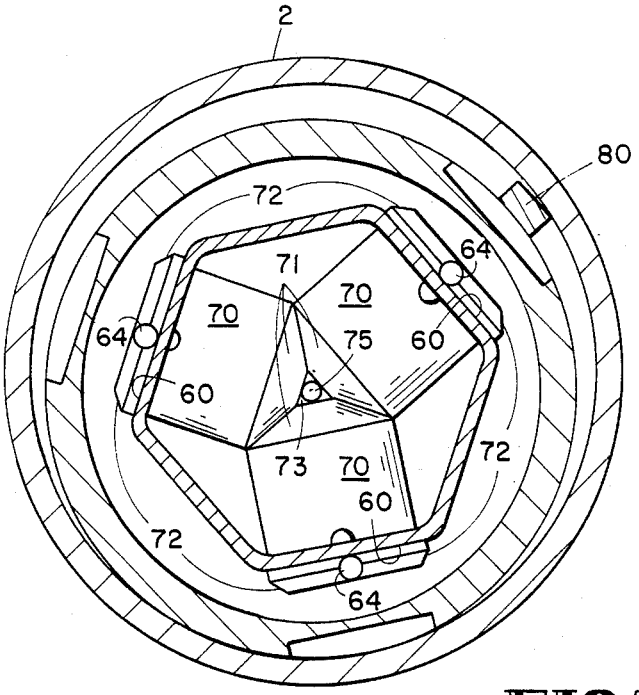

FIG. 5 is a view similar to FIG. 3 illustrating the other extreme angular position of the perforating gun.

DESCRIPTION OF THE PREFERRED EMBODIMENT

Referring to FIG. 1, a well casing 2 is schematically shown in installed relationship in a subterranean well 1 which passes through a production zone P at an angle to the vertical. As is well known to those skilled in the art, in order to produce fluid from the production zone, the casing 2 must be provided with a plurality of wall perforations directly adjacent to the production zone. It is known to be undesirable to produce perforations in a substantially vertically upward direction, inasmuch as this permits sand and other particulate material to freely flow or gravitate into the interior of the well casing. Accordingly, this invention provides an improved perforating gun 10 which is run into the well on a hollow conduit 5 which extends from the production zone P to the well head 4.

Referring now to FIGS. *2a* and *2b*, the perforating gun 10 embodying this invention will be seen to comprise an assemblage of a swivel unit 20, a firing head 30 and one or more perforating gun assemblages 40. Swivel unit 20 comprises a hanger sub 21 which is provided with internal threads 21*a* for securement to the bottom end of the tubular conduit 5. An annular bearing sleeve support 22 is secured to hanger 21 by threads 22*a*. The lower end of the bearing sleeve support 22 has an internally projecting shoulder 22*b* which defines a recess 22*c* for the mounting therein of a pair of axially spaced thrust bearings 23. Thrust bearings 23 are separated by an external shoulder 24*a* provided on the periphery of a hanger sleeve 24. The entire weight of the firing head 30 and one or more gun assemblages 40 are suspended from the hanger sleeve 24, but the thrust bearings 23 permit such suspended assemblies to freely rotate with respect to the hanger 21 and tubular conduit 5. Conventional seals 21*b* and 24*b* preserve the fluid sealed integrity of the assemblage.

The lower end of the hanger sleeve 24 is externally threaded as indicated at 24*c* and is thereby secured to a connector sub 25. The bottom end of connector sub 25 is externally threaded as indicated at 25*a* and these threads are employed to effect the securement thereto of a perforating apparatus including a percussion actuated firing unit 30 and one more perforating gun assemblies 40.

The firing unit 30 and the perforating gun assembly 40 may be of the same general type that are disclosed and claimed in co-pending application Ser. No. 366,267, filed Apr. 7, 1982, and assigned to the assignee of the present invention. As set forth in such co-pending application, the lower end of connecting sub 25 is connected by threads 25*a* to the upper end of a guide sleeve 26 which in turn is secured by threads 26*a* to the firing head 30. Guide sleeve 26 is provided with an inwardly sloped surface 26*b* which functions to direct any detonating weight dropped through conduit 5 toward the center of the bore of the guide sleeve 26.

Firing head 30 is of conventional configuration, having an upwardly projecting hammer 31 secured in an elevated position relative to a firing pin and detonating cartridge (not shown) which is in communication with an enlarged chamber 30*a* formed in firing head 30 and a booster charge 33 disposed in the upper end of a tubular housing hanger 34. The booster charge 33 comprises any conventional type of blasting cap, such as the C63 booster, manufactured by DuPont.

The lower end 30*b* of the firing head 30 is sealably secured to the top end of the tubular housing hanger 34 by threads 30*c* which are sealed by O-rings 34*a*.

The lower end of the tubular housing hanger 34 is threadably connected to the top end of the perforating gun assemblages 40 by threads 34*b* which are sealed by O-rings 34*c*.

The perforating gun assembly 40 comprises the housing hanger 34 and a chamber defining sleeve 42 which is secured to the lower end of the hanger 34 by the threads 34*b*. Sleeve 42 defines a vertical axis cylindrical chamber 44. The lower end of the chamber 44 is sealed either by a bull plug 46 or by an annular connector box 48. The connector box 48 is employed whenever it is desired to provide an additional chamber 44 for the mounting of additional explosive charges in the manner described in the aforesaid patent application. In the example shown in the drawings, two such perforating gun assemblies 40 are employed, hence, connector box 48 is secured to the bottom end of the sleeve 42 by threads 48*a* and the threads are sealed by O-rings 48*b*. A nipple 49 effects the connection of the connector box 48 to the top end of the second perforating gun assembly 40 through the medium of threads 49*a* and 49*b*, respectively sealed by O-rings 49*c* and 49*d*. The bull plug 46 is connected to the bottom end of the second sleeve 42 by threads 46*a* which are sealed by O-rings 46*b*.

The mounting of a plurality of perforating charges within any of the vertical axis cylindrical chamber 44 is accomplished most conveniently through the utilization of a supporting strip or carrier 60 having a polygonal configuration. Preferably, carrier 60 is of hexagonal cross-sectional configuration, as best shown in FIG. 3. In contrast to the construction disclosed in the above referred to co-pending application, only three sides of the hexagonal carrier 60 are employed for mounting shaped explosive charge containers 70 thereon. Three 120° spaced sides of the hexagonal carrier 60 are respectively provided with axially spaced apertures to respectively receive therein a plurality of shaped charge containers 70. Each container has a cylindrical body portion with a radial flange 72 formed on its outer extremity to provide an abutting engagement with the outer face of the hexagonal carrier 60. Flanges 72 thus maintain the exact radial orientation of the shaped charges when discharged.

Any suitable means, such as a C-spring (not shown) or rivets 74 may be employed to secure each shaped charge container 70 to the hexagonal carrier 60. The inner container ends 71 are conically shaped with the angle of the cone constituting an included angle of 120° so that such inner ends 71 lie closely adjacent to each other and define an axially extending opening 73 for reception of a primer cord 75 which is connected to the booster charge 33. When two or more perforating gun assemblies 40 are employed, additional booster charges 33 are provided respectively at the bottom and top ends of the primer cords 75 within the connector box 48 to insure the ignition of the lower primer cord 75.

In accordance with this invention, one or more radially projecting, axially extending ribs 80 are secured, as by welding 80*a* to each of the perforating gun assemblies 40. Such ribs are of relatively narrow extent, as best shown in FIG. 3, and shift the center of gravity of the gun so as to effect a gravitational bias on the perforating gun assemblage 40 to tend to rotate such gun assemblage in the casing 2 to a position where the rib 80 is disposed at the top of the gun assemblage, while the bottom side of the gun remains in contact with the casing wall, whenever the casing 2 deviates substantially from the true vertical. The radial height of ribs 80 is selected so as to permit a limited rocking or rotational motion of the perforating gun assemblage 40 relative to the casing 2. All such rotational movements relative to the casing 2 are permitted by the thrust bearings 23. Thus the gun 40 will gravitationally assume either the angular position of FIG. 4 or FIG. 5.

Ribs 80 are preferably mounted so that they are not more than 120° displaced from any vertical row of explosive charge containers 70. This means that if the ribs 80 are of substantial axial extent they may overlie one or more of the positions normally occupied by explosive charge containers 70. As illustrated in FIG. 3, when three rows of containers are employed at 120-degree angular spacing, the ribs 80 preferably overlie a portion of one of the container rows. To maintain the concentricity of the explosive charge containers 70, any containers thus overlaid by the rib 80 will be blank containers, not containing any explosive charge.

Additionally, when more than one perforating gun assembly 40 is employed, it is necessary that the ribs 80 on each of the gun assemblies be axially aligned. This may be conveniently accomplished through the introduction of one or more thin shims 81 between a radial flange 49*f* on the nipple 49 and the adjacent end of the connector block 48, so that when the threads 49*a* and 49*b* are fully engaged, the ribs 80 on the respective perforating gun assemblies 40 will be axially aligned.

It is therefore apparent that whenever perforation of a non-vertical section of a well casing is required, a perforating gun assemblage incorporating this invention will insure that none of the active explosive charges are directed in a substantially upward direction. Even when taking into account the slight angular rocking of the perforating gun assemblages about the ribs 80 that occurs within the well casing 2, the active explosive charges will probably still be disposed at an angle no less than 45° with respect to the vertical, which is quite adequate to minimize the entrance of sand or other particulate material through the resulting perforations.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Well perforating apparatus for use with a tubular conduit extending from the well head to a point above the casing zone to be perforated, said conduit being capable of carrying fluid, comprising: an axially concentric perforating gun assembly including a plurality of angularly and axially spaced explosive charge containers; the angular spacing of said containers being 120 degrees and said containers being aligned in three axially extending rows; a swivel unit connecting said perforating gun assembly to the end of the tubular conduit, said swivel unit comprising an annular thrust bearing thereby permitting rotation of said perforating assembly relative to the conduit; and an axially extending narrow rib on the exterior of said perforating gun assembly aligned with and overlying a portion of one said row of containers, the containers overlaid by said rib being blank, which shifts the center of gravity to cause said perforating gun assembly to gravitationally rotate in any non-vertical section of the well casing to position said rib in engagement with the upper wall portion of the non-vertical casing section; said rib being angularly positioned relative to all the explosive charge containers so that no explosive charge is directed vertically upward.

2. Well perforating apparatus in accordance with claim 1 wherein said perforating gun assembly comprises a plurality of said tubular housings each containing one said tubular carrier, threaded joints interconnecting said tubular housings, and shim means in said threaded joints for axially aligning said ribs on the exteriors of said tubular housings.

* * * * *